US008055146B2

(12) United States Patent
Nishida et al.

(10) Patent No.: US 8,055,146 B2
(45) Date of Patent: Nov. 8, 2011

(54) IMAGE FORMING APPARATUS WITH IMAGE COVERING DENSITY CALCULATING SECTION

(75) Inventors: Satoshi Nishida, Saitama (JP); Toshiki Hayami, Hachioji (JP); Masato Kubota, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 216 days.

(21) Appl. No.: 12/431,359

(22) Filed: Apr. 28, 2009

(65) Prior Publication Data

US 2009/0274475 A1 Nov. 5, 2009

(30) Foreign Application Priority Data

May 1, 2008 (JP) ..... 2008-119593

(51) Int. Cl.
*G03G 15/00* (2006.01)

(52) U.S. Cl. ..... 399/49

(58) Field of Classification Search ..... 399/49
See application file for complete search history.

(56) References Cited

FOREIGN PATENT DOCUMENTS

| | | | |
|---|---|---|---|
| JP | 2002-108161 | A | 4/2002 |
| JP | 2002-328496 | A | 11/2002 |
| JP | 3835503 | B2 | 8/2006 |

OTHER PUBLICATIONS

Machine translation of JP 2002-328496 A.*
English translation of JP 2002-328496 A.*
Japanese Office Action for Application No. 2008-119593 mailed Apr. 20, 2010 with English translation.

* cited by examiner

*Primary Examiner* — David Gray
*Assistant Examiner* — Ruth Labombard
(74) *Attorney, Agent, or Firm* — Cantor Colburn LLP

(57) ABSTRACT

An image forming apparatus, including: an image carrier; an image forming section to form a toner image on the image carrier; a transfer section to transfer the toner image formed on the image carrier to an intermediate transfer body or a recording sheet; a cleaning section to remove not transferred toner particles remaining on the image carrier, an image covering density calculating section to calculate an average image covering density of the toner image formed on plural areas divided in a lateral direction of the image carrier, during a predetermined time period; an obtaining section to obtain a difference of the average image covering density in each divided area, based on the image covering density calculated by the image covering density calculating section; and an adjusting section to adjust an amount of abrasive particles to be supplied to each divided area, based on the differences obtained by the obtaining section.

13 Claims, 5 Drawing Sheets

ARROW "a" SHOWS MOVING DIRECTION OF PHOTOCONDUCTOR.
ARROW "b" SHOWS LATERAL DIRECTION OF PHOTOCONDUCTOR.

IMAGE FORMING APPARATUS WITH IMAGE COVERING DENSITY CALCULATING SECTION

CROSS REFERENCE TO RELATED APPLICATION

This application is based on Japanese Patent Application No. 2008-119,593 filed on May 1, 2008, with the Japanese Patent Office, the entire content of which is hereby incorporated by reference.

TECHNICAL FIELD

The present invention relates to an image forming apparatus, such as an electro-photographic copying apparatus and a printer, and in particular, to an image stabilizing technology for the image forming apparatus, in which toner images, which have been formed on an image carrier, such as a photoconductor drum, are transferred onto a transfer member, such as a recording sheet.

BACKGROUND OF THE INVENTION

In recent years, electro-photographic image forming apparatuses have been used in the field of shortrun printing, in which the quality of printed images and operating stability of the apparatus required for such apparatuses, have become very higher and much severer. Further, a large number of technologies have been proposed, by which the printed images exhibiting such high quality can be offered stably for long periods.

In the above usage, a new problem concerning the printed images has been realized, which is uneven reflection density exhibiting longitudinal streaks.

Said streaks will now be detailed.

If an original document, exhibiting various reflection densities of the image in the lateral direction perpendicular to a moving direction of an image carrier (which is a photoconductor), is continuously printed on recording sheets, and if a subsequent original document, carrying an even half-tone image over its total imaging area, is printed on a recording sheet, the above-described streaks are observed on said recording sheet, which are corresponding to the lateral distribution of the reflection density of said original document. Further, the higher the number of continuous prints increases, the more said uneven reflection density tends to occur.

After studying possible reasons of the occurrence of said uneven reflection density, the inventors presumed the occurrence mechanism described below.

The presumed occurrence mechanism will now be detailed.

Finding 1. When not transferred toner particles, remaining on the photoconductor, are removed from the surface of the photoconductor by an edge of a cleaning blade, the surface of the photoconductor is mechanically abraded.

Finding 2. Concerning said abrasion, occurred on the surface of the photoconductor due to the edge of the cleaning blade, the more the amount of the not transferred toner particles, supplied to the cleaning section, the more the rate of abrasion increases.

Finding 3. When the density of a toner image, formed on the photoconductor increases, (that is, when the amount of toner particles adhered on the photoconductor increases), the amount of not transferred toner particles increases.

Based on the relationship shown in Findings 1, 2 and 3, when the surface of the photoconductor is divided into plural areas in the lateral direction, being perpendicular to the moving direction of the photoconductor, the amount of abrasion in each area depends upon an average character coverage ratio of each area. That is, if a previous print carries a reflection density distribution of the images in the lateral direction (being a distribution of the average character coverage ratio), the amount of abrasion changes slightly in each area of the photoconductor, corresponding to the average character coverage ratio of each area.

When the original document, carrying the above-described reflection density distribution of the images in the lateral direction, is repeatedly printed on a large number of the recording sheets, said slight changes of the amount of abrasion accumulate, whereby an area of uneven thickness of the photoconductor increases, and thereby the uneven reflection density becomes visible. In a normal case, in an area exhibiting lower thickness of the photoconductor, the half tone image becomes darker, compared with an area exhibiting relatively greater thickness of the photoconductor.

Further, though the occurrence mechanism differs from the above-described uneven reflection density exhibiting streaks, a technology is offered to prevent the problem of an image quality, which occurs when the original document, carrying a white area or relatively low reflection density image, in the lateral direction perpendicular to the moving direction of the photoconductor, is repeatedly printed on the recording sheets.

Japanese Patent 3,835,503 concerns the problem of image quality, in which bleeding or blurring is generated on the printed images, due to materials which prevent formation of latent images, accumulating on the white areas or the low reflection density areas in the lateral direction of the surface of the photoconductor.

In said Japanese Patent, the image covering density, in an image area on an image carrier facing a transfer sheet, is calculated, whereby in order to supply toner particles to white areas, or to lateral areas of the low image covering density, corresponding to low reflection areas, a toner band (being a toner patch image) is formed at inter-image areas between the image areas, aligned in the moving direction of the surface of the image carrier. Due to a polishing function of the toner particles, at contact portions of the cleaning blade, at the toner band, the materials to prevent formation of the latent images do not accumulate on the surface of the image carrier, whereby image bleeding and blurring are prevented from occurring on the produced image.

That is, the image covering density, at each lateral area in the lateral direction perpendicular to the moving direction of the surface of the image carrier, is checked whether the image covering density exceeds a predetermined threshold value or not, after that, the toner particles are supplied to the lateral areas exhibiting the image covering density which is less than the threshold value.

Accordingly, due to the technology listed in the above Patent Document, the uneven reflection density exhibiting the streaks cannot be totally overcome, which occurs due to the difference of the average image covering density, compared between lateral areas distributed in the lateral direction, or which occurs due to white areas or low density areas. Further, no toner particles are supplied to lateral areas of the image carrier, onto which no transfer sheet is introduced. Accordingly, if original documents of a narrow width of images, are continuously printed, and then an original document of a greater width of images and carrying the half-tone images, is subsequently printed, an image, formed on the areas of the image carrier, at which no toner particles were supplied, exhibits lower density as longitudinal strips, compared to areas of the image carrier on which the transfer sheet was introduced, which is a new problem to be solved.

Unexamined Japanese Patent Application Publication 2002-328,496 relates to a problem being specific to a single component developer, in which when original documents, carrying a low character coverage ratio, are continuously printed, since very few toner particles fly to the photoconductor drum from a developing sleeve, the toner particles remain on the developer sleeve without fly, whereby due to said remaining toner particles, the density of the printed image is adversely lowered, or fog is generated on the printed image. To overcome these problems, a black even pattern is formed on areas of the photoconductor, corresponding to the areas exhibiting a character coverage ratio of less than a predetermined value, whereby the toner particles of the developer sleeve corresponding to said areas are selected to be conveyed onto the photoconductor, so that the toner particles on the developer sleeve of the developing device are refreshed.

Accordingly, due to reasons described below, the technology disclosed in Unexamined Japanese Patent Application Publication 2002-328,496, cannot prevent the uneven reflection density, visible as streaks.

In the technology disclosed in Unexamined Japanese Patent Application Publication 2002-328,496, the character coverage ratios of specific lateral areas across the total lateral area are calculated. However, since only a predetermined amount of toner particles are supplied to each specific lateral area, having a character coverage ratio being less than the predetermined value, any abrade gap is not closed on the surface of the photoconductor which has become worn, due to the difference of the densities in the areas, as far as the character coverage ratio is greater than the predetermined value. Accordingly, any uneven reflection density exhibited by streaks, which is caused by differences of the average image covering density in each lateral area on the lateral distribution, still exists adverse.

SUMMARY OF THE INVENTION

The present invention has been achieved, with regard to the above situation, wherein an object of the present invention is to supply a technology to prevent uneven reflection density exhibiting streaks, which is generated, when original documents, carrying an image having different reflection densities in the lateral direction, perpendicular to the moving direction of the image carrier (being the photoconductor), are continuously printed, and a technology to stably maintain the printed images with higher quality, for a long time.

Above object will be attained by the invention listed below.

In an image forming apparatus, including:

an image carrier;

an image forming section to form a toner image on the image carrier;

a transfer section to transfer the toner image formed on the image carrier to an intermediate transfer body or a recording sheet;

a cleaning section to remove not transferred toner particles remaining on the image carrier, an image covering density calculating section to calculate an average image covering density of the toner image formed on plural areas divided in a lateral direction of the image carrier, during a predetermined time period;

an obtaining section to obtain a difference of the average image covering density in each divided area, based on the image covering density calculated by the image covering density calculating section; and an adjusting section to adjust an amount of abrasive particles to be supplied to each divided area, based on the differences obtained by the obtaining section.

BRIEF DESCRIPTION OF THE DRAWINGS

Embodiments will now be described, by way of examples only, with reference to the accompanying drawings which are meant to be exemplary, not limiting, and wherein like elements are numbered alike in the several figures, in which.

DETAILED DESCRIPTION OF THE PREFERRED EMBODIMENTS

Figure 1:
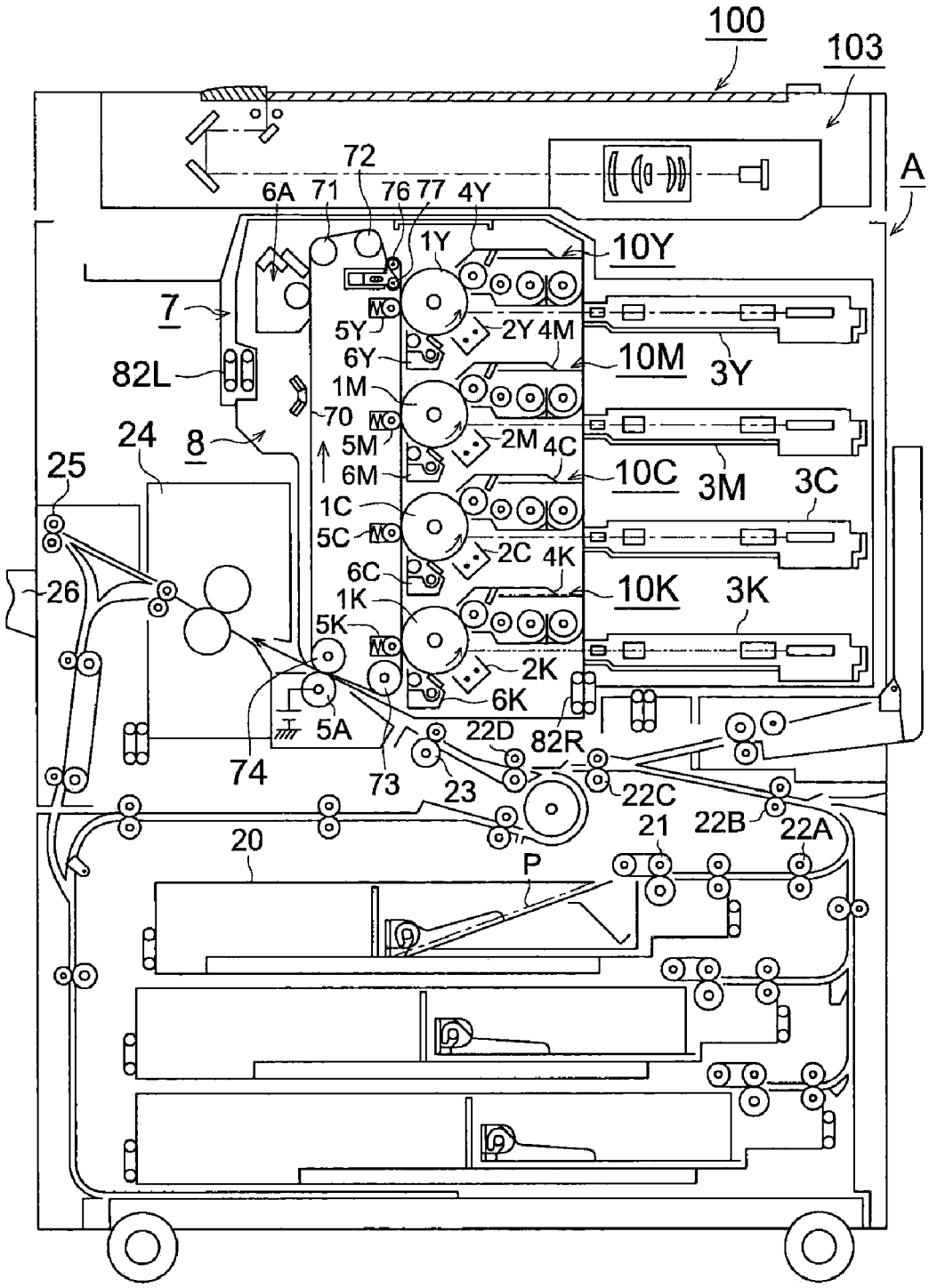
FIG. 1 is a whole structuring view of the full color image forming apparatus, relating to embodiments of the image forming apparatus of the present invention.

The embodiments of the present invention will now be detailed, while referring to the drawings. The descriptions in this specification are not to limit the technical scopes of the claims nor the meaning of the terms. Further, the basic explanations of the embodiments of the present invention shows the best mode, but are not to limit the meaning of the terms nor the technical scope of the present invention.

FIG. 1 is a whole structuring view of the full color image forming apparatus, relating to the embodiments of the image forming apparatus of the present invention.

Printer section 101 of image forming apparatus 100 is called a "tandem type full color image forming apparatus", which is structured of image forming sections 10Y, 10M, 10C and 10K, intermediate transfer body 7, serving as an intermediate transfer unit, being an endless belt, sheet supplying section 21, and fixing device 24. Scanning exposure device 103 is installed above printer section 101.

Image forming section 10Y, which forms yellow toner images, has photoconductor 1Y, being a drum, charging section 2Y, image exposure section 3Y, developing device 4Y, primary transfer roller 5Y, serving as a primary transfer section, and cleaning section 6Y, all of which are arranged around photoconductor 1Y.

Image forming section 10M, which forms magenta toner images, has photoconductor 1M, being a drum, charging section 2M, image exposure section 3M, developing device 4M, primary transfer roller 5M, serving as a primary transfer section, and cleaning section 6M, all of which are arranged around photoconductor 1M.

Image forming section 10C, which forms cyan toner images, has photoconductor 1C, being a drum, charging section 2C, image exposure section 3C, developing device 4C, primary transfer roller 5C, serving as a primary transfer section, and cleaning section 6C, all of which are arranged around photoconductor 1C.

Image forming section 10K, which forms black toner images, has photoconductor 1K, being a drum, charging section 2K, image exposure section 3K, developing device 4K, primary transfer roller 5K, serving as a primary transfer section, and cleaning section 6K, all of which are arranged around photoconductor 1K.

Figure 2:
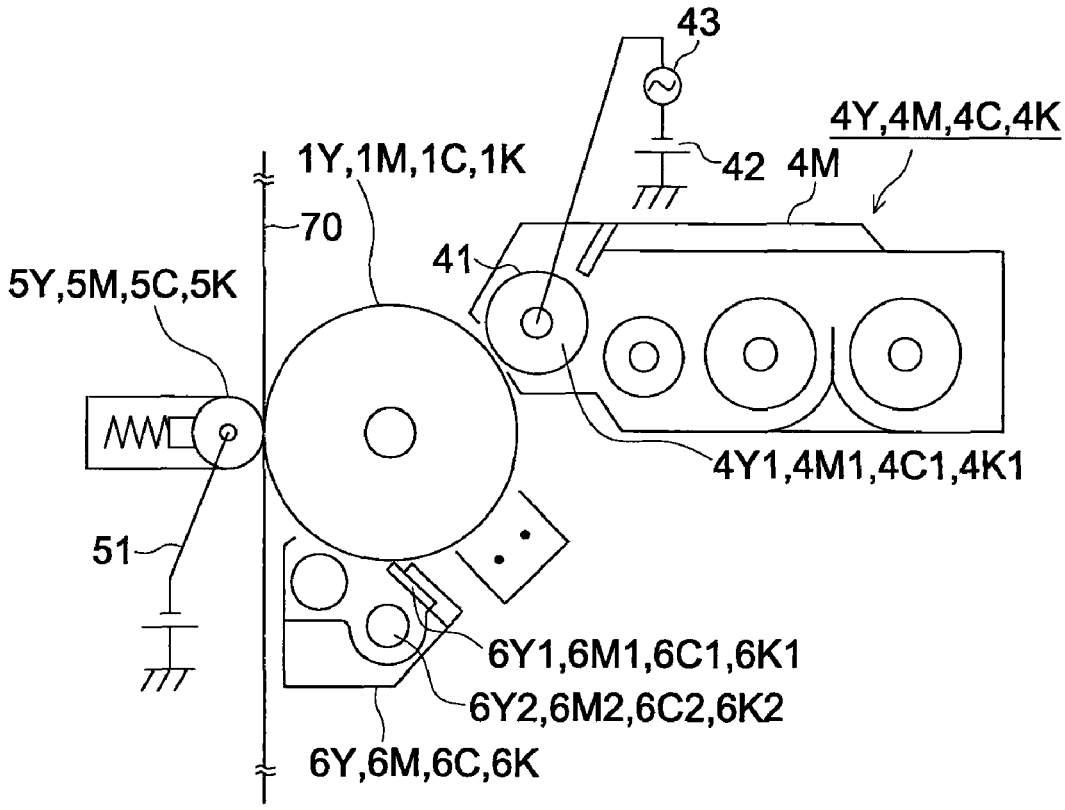
FIG. 2 is an enlarged view of a portion of the image forming section.

FIG. 2 is an enlarged view of the image forming sections 10Y, 10M, 10C and 10K, which will be detailed later, as appropriate.

Intermediate transfer body unit 7 serving as the intermediate transfer unit, includes intermediate transfer body 70, being a semi-conductive endless belt, which is entrained about a plurality of rollers so that said belt can rotate.

Each color toner image, formed by image forming sections 10Y, 10M, 10C and 10K, is primarily and sequentially transferred onto rotating intermediate transfer body 70 by transfer rollers 5Y, 5M, 5C and 5K, so that each color image is superposed, so that a full color image is formed on intermediate transfer body 70. Transfer member P being a recording sheet, serving as a transfer member, stored in sheet supplying cassette 20, are sequentially conveyed by sheet supplying section 21, through plural intermediate rollers 22A, 22B, 22C, and 22D, and paired registration rollers 24, to secondary transfer roller 5A, serving as a secondary transfer section, where the full color image is transferred onto transfer member P.

Transfer member P, onto which the full color image has been transferred, is heated and pressed at fixing device 24, so that the full color image is fixed onto transfer member P. Then, transfer member P is ejected by paired ejection rollers 25 onto sheet ejection tray 26.

Concerning intermediate transfer body 70 which has already transferred the full color image onto transfer member P via secondary transfer roller 5A and separated transfer member P from its surface, any remaining toner on intermediate transfer body 70 is cleaned via cleaning section 6A.

During the image forming process, primary transfer roller 5K is always pressed against photoconductor 1K. Other primary transfer rollers 5K, 5M, and 5C are pressed against respective photoconductors 1Y, 1M and 1C, during the color image formation.

Secondary transfer rollers 5A is pressed against intermediate transfer body 70, only when transfer member P reaches said secondary transfer roller 5A to be secondary-transferred.

Chassis 8 can be drawn out from image forming apparatus 100 through supporting rails 82L and 82R.

Chassis 8 is structured of image forming sections 10Y, 10M, 10C and 10K, as well as intermediate transfer body unit 7.

Image forming sections 10Y, 10M, 10C and 10K are tandem-arranged vertically. Intermediate transfer body unit 7 is arranged at the left side of photoconductors 1Y, 1M, 1C and 1K as shown in FIG. 1.

Intermediate transfer body unit 7 is structured of intermediate transfer body 70, which can be rotated, being entrained about rollers 71, 72, 73, 74, 75, 76 and 77, primary transfer rollers 5Y, 5M, 5C and 5K, and cleaning section 6A.

By drawing operation conducted on chassis 8, image forming sections 10Y, 10M, 10C and 10K and intermediate transfer body unit 7 are together drawn away from image forming apparatus 100.

By the above structures, the toner images of colors Y, M, C and K are respectively formed on photoconductors 1Y, 1M, 1C and 1K, by the electrical charging process, the exposure process and the developing process. After that, these images are superposed on intermediate transfer body unit 7 as the primary transfer operation, and said superposed images are totally transferred onto transfer member P as the secondary transfer operation, whereby said transfer member P is permanently fixed by the application of heat and pressure at fixing device 24.

After that, any toner particles, remaining on photoconductors 1Y, 1M, 1C and 1K, are removed by cleaning sections 6Y, 6M, 6C and 6K, respectively.

In detail, cleaning blades 6Y1, 6M1, 6C1 and 6K1 of cleaning sections 6Y, 6M, 6C and 6K, are supported on casings of said cleaning sections to come into contact with the surfaces of photoconductors 1Y, 1M, 1C and 1K, whereby any toner particles remaining on the photoconductors can be removed. The removed toner particles are conveyed to recovery sections, which are not illustrated, by recovering screws 6Y2, 6M2, 6C2 and 6K2.

The above described electrical charging operation, exposure operation and development operation are cyclically repeated, so that next image formation is conducted.

Image forming apparatus 100 of the present invention represents a tandem type full color copier, in which an intermediate transfer body including an endless belt is employed.

Concerning an actual example used in the present invention, the system speed represents 300 mm/sec, photoconductors 1Y, 1M, 1C and 1K respectively represent organic photoconductors, at a diameter of 60 mm, the developer represents a dual component developer, and the electrical voltage, including the AC voltage superimposed on the DC voltage, are applied on developing rollers 4Y1, 4M1, 4C1, and 4K1 of developing devices 4Y, 4M, 4C and 4K, respectively.

As the primary transfer operation, the electrical bias voltage is applied onto primary transfer rollers 5Y, 5M, 5C and 5*k*, which are covered with semi-conductive Sponge (being the registered trademark), so that the image on the photoconductor is transferred onto the intermediate transfer body. The resister value of the primary transfer roller represents $1\times10^7\Omega$. The constant-current system to control the output current is employed as the bias power source.

As the secondary transfer operation, secondary transfer roller 5A and backup roller 74 are paired to sandwich intermediate transfer body 70 and transfer member P. Cored metal rods of both secondary transfer roller 5A and backup roller 74 are covered with semi-conductive solid rubber. When the electrical voltage is applied to the cored metal rod of backup roller 74, while the cored metal rod of secondary transfer roller 5A is grounded, the full color image on intermediate transfer body 70 is transferred onto transfer member P. The constant-current system to control the output current is employed as the bias power source.

In FIG. 2, the electrical developing bias, applied onto developing rollers 4Y1, 4M1, 4C1, and 4K1 of developing devices 4Y, 4M, 4C and 4K, represents alternating current voltage bias (being AC bias) 43, superimposed on direct current voltage bias (being DC bias) 42. DC bias 42 applies the constant bias onto non-image areas as well as on image areas. When the image carrying areas of the photoconductor passes through developing rollers 4Y1, 4M1, 4C1, and 4K1, AC bias 43 outputs a constant voltage onto the image areas of the photoconductor, but does not output a constant voltage onto the inter-image area, positioned between the image areas. However, when a toner patch image, relating to the present invention, which is to be detailed later, is to be formed on the inter-image areas, a constant voltage is applied to the image areas as well as to the inter-image areas, including registration marks.

Further, concerning the bias voltage, applied onto primary transfer rollers 5Y, 5*m*, 5C and 5K, when the image area of the photoconductor passes through the primary transfer section, a constant voltage is applied. Still further, when the inter-image areas of the photoconductor pass through the primary transfer section, the voltage is changed to a voltage which does not transfer the toner particles on the photoconductor to the intermediate transfer body. Accordingly, toner patch images existing in the non-image area, which will be detailed later, are not transferred, and remain on the photoconductor. After the image is transferred, primary transfer rollers 5Y, 5M, 5C and 5K separate from photoconductor 1Y, 1M, 1C and 1K, respectively.

Figure 3:
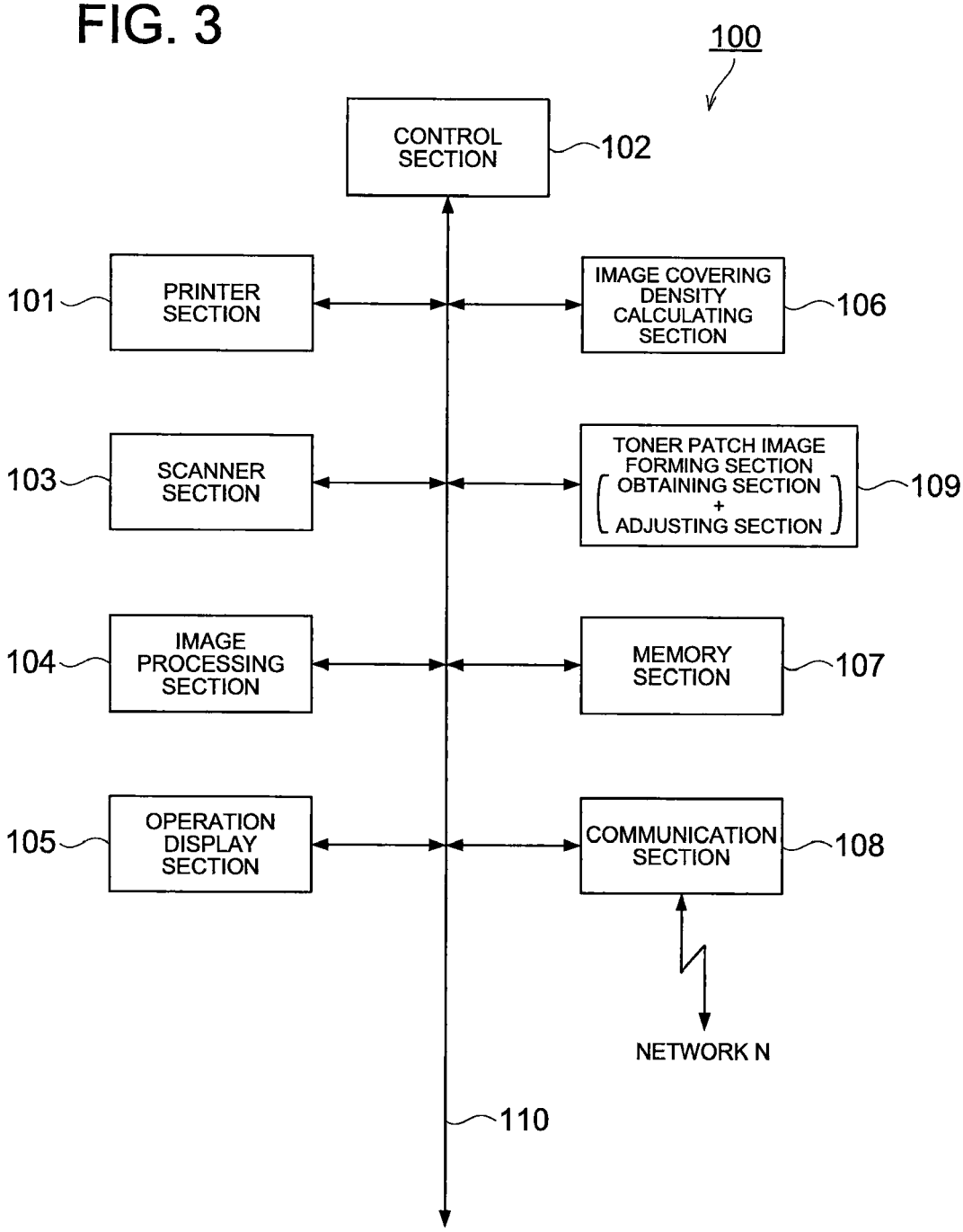
FIG. 3 is a block diagram of a control system of the image forming apparatus of the present invention.

FIG. 3 is a block diagram of the control system of image forming apparatus 100 of the present invention, which shows printer section 101, control section 102, scanner section 103, image processing section 104, operation display section 105, image covering density calculating section 106, memory section 107, communication section 108, and toner patch image forming section (which includes an obtaining section and an adjusting section) 109, or the like sections. Each section is connected by bus 110.

Control section 102 is structured of CPU (being a Central Processing Unit), ROM (being Read Only Memory), and RAM (being Random Access Memory). The CPU of control section 101 reads out system programs and various processing programs, which are stored in ROM, and distributes them onto RAM. The CPU controls each section of image forming apparatus 100, based on the above programs.

Operation display section 105, structured of LCD (being a Liquid Crystal Display), displays various operating buttons, and various operating conditions and functions of the apparatus, based on instruction signals inputted through control section 102. A display section of said LCD includes a pressure-sensitive touch panel (being a resistive touch display), on which transparent electrodes are aligned in a reticular pattern. Coordinates [X, Y] of a point, which is depressed by a finger or a special touch pen, are detected as electrical voltages to show positional signals, which are outputted to control section 102 as operation signals. Operation display section 105 includes various operation buttons, such as numerical buttons and a start button, whereby the operation signals, produced by operator's button operation, are outputted to control section 102.

Scanner section 103 is formed of a scanner, mounted under a flat glass platen to support the original document, whereby said scanner section 103 reads an image carried on the original document. Said scanner is structured of a light source, a CCD (being a Charge Coupled Device), an A/D converter, and similar electronic devices. The original document is scanned to be exposed by the light rays emitted from the light source, and the reflected light rays are converted photo-electrically, so that the image carried on the original document is read to be signals R, G and B. The image, read by scanner section 103, is converted from analog to digital signals, and outputted to image processing section 104. The image in this case means not only image data, such as a photograph or sketch, but also text data, such as characters, numbers and symbols.

On the image data read by scanner section 103, image processing section 104 conducts various image processing operations, such as enlargement, reduction, rotation, frequency conversion, color conversion from RGB data to YMCK data, and gradation correction. Further, on the image data sent through communication section 108, image processing section 104 conducts various image processing operations, such as color conversion from RGB data to YMCK data, and gradation correction. Via above processing operations, image processing section 104 generates printing data of each color Y, M, C and K. Image processing section 104 outputs said printing data of each color to image covering density calculating section 106, based on the instruction from control section 102, after that, image processing section 104 outputs said printing data of each color to printer section 101.

Image covering density calculating section 106 calculates the average image covering density for each lateral area, using said printing data of each color, transferred from image processing section 104. Subsequently, information concerning the average image covering density of the printing data of each color, which is represented by the average image covering density in each lateral area, calculated by image covering density calculating section 106, is outputted to toner patch image forming section 109. Image covering density calculating section 106 represents the "image covering density calculating section" of the present invention.

Figure 4:
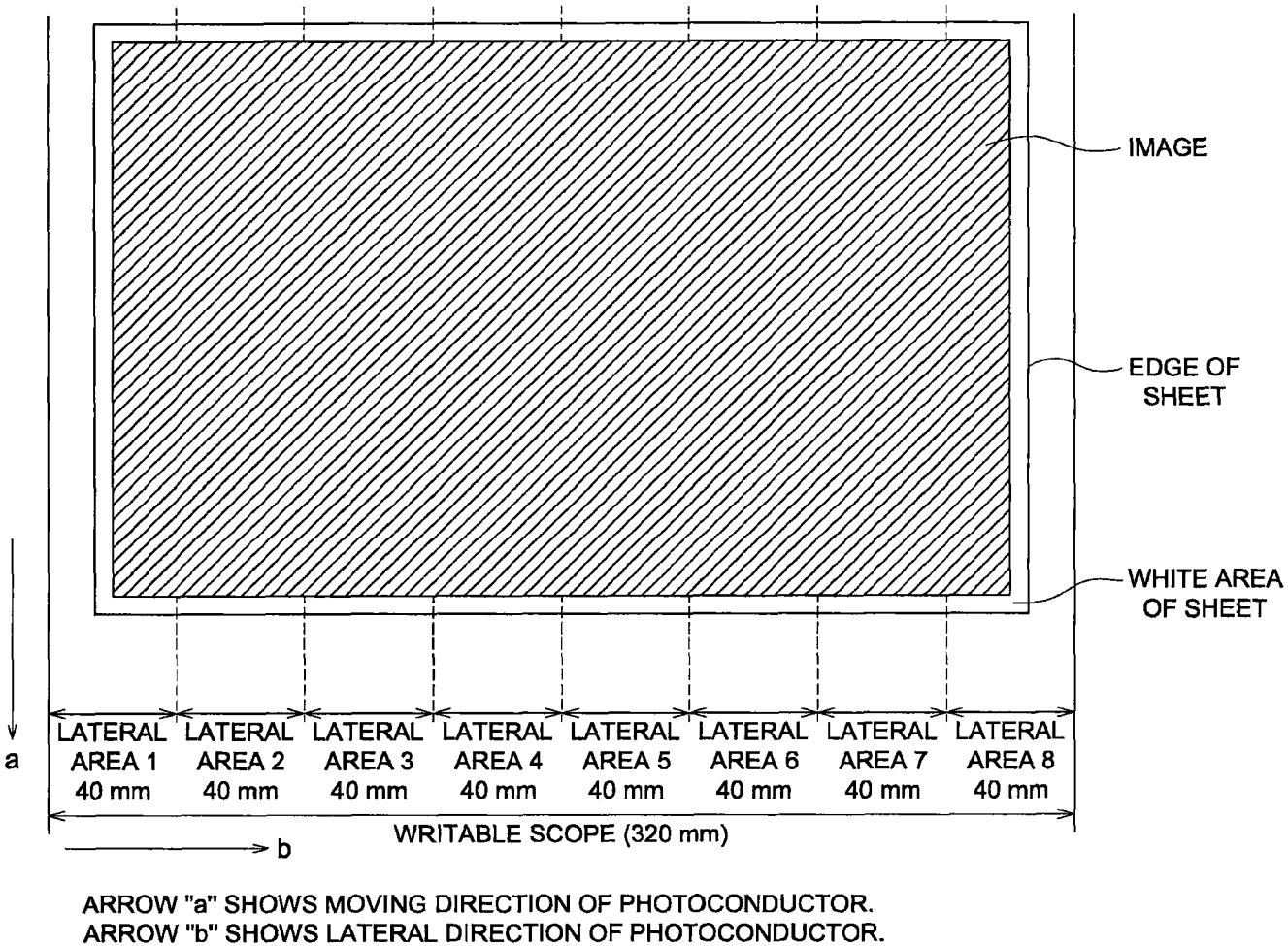
FIG. 4 details a lateral area in which an image area of the photoconductor is divided into plural areas in a lateral direction.

FIG. 4 shows the above-described lateral area. Said lateral area represents an area existing in a lateral direction perpendicular to the rotation direction of the photoconductor, the surface of which is to be divided into plural areas, each being a "divided area".

In the present invention, each lateral area is 40 mm in width. Portions in each of photoconductors 1Y, 1M, 1C and 1K, on which the image is to be written, is 320 mm of lateral length, which is equally divided into 8 portions.

In this case, to simply calculate the average image covering density (being the character coverage ratio), the width in each lateral area has been made to be equal, but it need not always be so.

Further, a number to divide the overall width is 8, but again it need not always be so. Generally, the more the dividing number increases, the more precise the lateral distribution of the average image covering density becomes, however, any increase of division results in a heavier load of the calculation of the average image covering density. Accordingly, the numbers should be determined appropriately, based on an actual need.

To calculate the average image covering density, the various methods listed below are well-known.

In a case that printing data of each color is structured of two values, the number of active image elements (being formed of dots), is counted in each of the lateral areas while printing is conducted, so that the number of total active image elements is obtained, and said number is represented by "N". Subsequently, "N" is divided by total image elements "No" in each lateral area, whereby average image covering density "N/No" in each lateral area is calculated. In this case, the average image covering density is generally referred to as "the average character coverage ratio".

Further, in a case that the printing data of each color is structured of multiple values, the average image covering density is calculated by the procedures shown below.

(1) When the writing intensity of image element "j" within the lateral area is represented by "ij", writing intensity "ij" for each image element "j" is added with respect to total image elements (j=1, 2, 3, - - - J) across the lateral areas in a predetermined duration, whereby integrated value "I" is obtained.

(2) When writing intensity "ij" is set to be the maximum for the total image elements, the integrated value is represented by "Io", being a known value. Above integrated value "I" is then divided by known integrated value "Io". That is, "I/Io" can be obtained as an average image covering density for each lateral area.

However, the above procedures take a lot of trouble with calculation. As a more concise procedure, the number of image elements, carrying writing intensity "ij" which is greater than a predetermined threshold value, is counted, whereby said counted number is represented by "N". Subsequently, average character coverage ratio "N/No" can be obtained, which is then used instead of average image covering density "I/Io".

Toner patch image forming section 109 is structured of an obtaining section and an adjusting section (See FIG. 3). The obtaining section obtains the difference between a standard value and the average image covering density in each lateral area, based on information concerning the average image covering density of the printing data of each color, which is sent from image covering density calculating section 106. The adjusting section forms toner patch image information, whereby the amount of toner particles (being the abrasive particles) is adjusted in order that the image forming section of each color supplies the suitable toner particles to the non-image area in the moving direction of the photoconductor, based on the above difference which is obtained by said obtaining section.

The obtaining section of the toner patch pattern forming section refers to "an obtaining section" of the present invention, while the adjusting section refers to "an adjusting section" of the present invention.

Toner patch image forming section 109 makes said toner patch image information to pair with identification information of the printing data of each color, and sends paired information to printer section 101.

First Embodiment

Several embodiments of toner patch image forming section 109 will now be sequentially detailed, firstly of which the First Embodiment will now be detailed.

Procedure 1: Maximum value of printing data of each color is obtained, based on the average image covering density in each lateral area. The obtained maximum value is referred to the standard value.

Procedure 2: The difference, which is between the standard value in Procedure 1 and the average image covering density of each area, is obtained.

Procedure 3: Comparing the difference obtained in Procedure 2, to a conversion table (being a conversion graph), previously stored in memory section 107 of image forming apparatus 100, the densities (being the gradation area ratios) of the toner patches in each lateral area, which are depending on the difference in each lateral area, are sequentially obtained. By the obtained densities of the toner patches, "the amount of abrasive toner particles to be supplied to each divided area" in the present invention can be adjusted.

Concerning the forming method of the toner patch images, a two-value gradation method, to change an occupation ratio of the active image dots, is simple and suitable to use.

Figure 5:
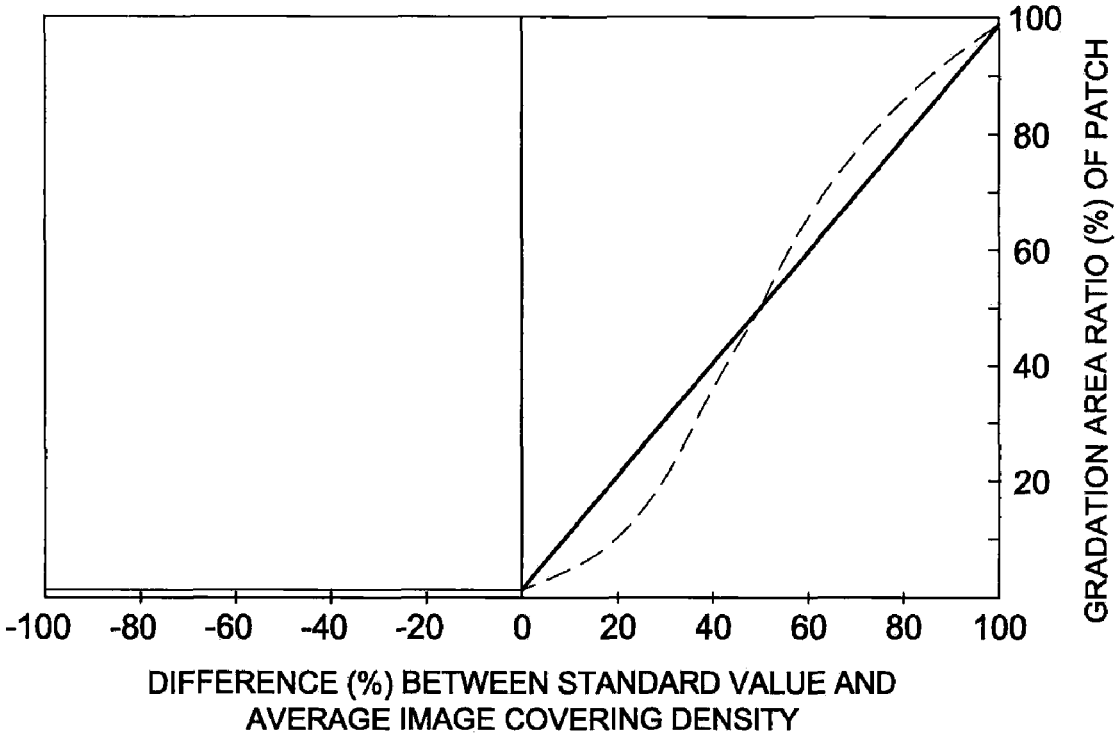
FIG. 5 is a graph to show the relationship of the difference between the standard value and the average image covering density in each lateral area, and a gradation area ratio of the toner patch image.

FIG. 5 is a graph showing the relationship of the difference between the standard value and the average image covering density in each lateral area, and a gradation area ratio of the toner patch image.

Said relationship is changed to be a table, which is stored in memory section 107, so that said table represents the conversion table, shown by the solid line, in procedure 3.

Procedure 4: Toner patch image information, which is structured of each lateral area and the density of the patch (being a gradation area ratio) at individual lateral areas, is paired to each color printing information, whereby said toner patch image information and said each print information are sent to printer section 101.

Printer section 101 temporarily stores the printing data (which are Y, M, C and K printing data), conveyed from image processing section 104, in a predetermined area of memory section 107. Further, printer section 101 pairs toner patch image information, which is sent from toner patch image forming section 109, and each color printing data, and temporarily stores them in a predetermined area of memory section 101.

After that, based on the printing instructions (being the starting instruction, and the processing instructions, such as, the number of prints, the full-color or monochromatic printing process, double surfaces or single surface printing process, and the like processes) concerning the printing data, sent from control section 102, printer section 101 receives the printing data (which are Y, M, C and K printing data), and the toner patch image corresponding to the printing data, from memory section 107, whereby printer section 101 enables each image forming section, to form Y printing data, M printing data, C printing data, and K printing data, on each image area of photoconductors 1Y, 1M, 1C and 1K. Subsequently, printer section 101 forms Y toner patch image, M toner patch image, C toner patch image, and K toner patch image, on inter-image areas (being the non-image areas positioned between the image areas in the circumferential direction) at the downstream sides of each image area. The lateral size of the toner patch image, formed on each area of photoconductors 1Y, 1M, 1C and 1K, is 40 mm, being a fixed value. The circumferential size of the patch image is proportional to the circumferential size of the image area, as well as an image transfer ratio. In the present explanation, said circumferential size of a crosswise A4 image (that is, in which the circumferential length is 210 mm), in which its longer edges are placed parallel to the sheet conveyance direction, is 1.5 mm, while that of a lengthwise A3 image (that is, the circumferential length is 300 mm), in which its longer edges are placed perpendicular to the sheet conveyance direction, is 3 mm.

TABLE 1

| Lateral | Average image covering density (%) | | | | Difference between standard value and average image covering density in each lateral area (%) | | | | Gradation area ratio of toner patch (%) | | | |
|---|---|---|---|---|---|---|---|---|---|---|---|---|
| areas | Y | M | C | K | Y | M | C | K | Y | M | C | K |
| Area 1 | 20 | 0 | 20 | 0 | 80 | 20 | 80 | 10 | 80 | 20 | 80 | 10 |
| Area 2 | 50 | 15 | 50 | 8 | 50 | 5 | 50 | 2 | 50 | 5 | 50 | 2 |
| Area 3 | 55 | 20 | 55 | 8 | 40 | 0 | 40 | 2 | 40 | 0 | 40 | 2 |
| Area 4 | 70 | 10 | 70 | 10 | 30 | 10 | 30 | 0 | 30 | 10 | 30 | 0 |
| Area 5 | 70 | 15 | 70 | 10 | 30 | 5 | 30 | 0 | 30 | 5 | 30 | 0 |
| Area 6 | 85 | 10 | 85 | 10 | 15 | 10 | 15 | 0 | 15 | 10 | 15 | 0 |
| Area 7 | 100 | 10 | 100 | 8 | 0 | 10 | 0 | 2 | 0 | 10 | 0 | 2 |
| Area 8 | 70 | 0 | 70 | 0 | 30 | 20 | 30 | 10 | 30 | 20 | 30 | 10 |
| | 100 | 20 | 100 | 10 | ←standard value (being maximum value) | | | | | | | |

Table 1 shows the toner patch pattern formation of the First Embodiment, as a case example. The first column represents lateral areas 1, 2, - - - 8. The second column represents the average image covering density (%) in each lateral area, calculated by the printing data of each color, in which 5,000 prints are actually and continuously formed. The lowest row shows the standard values in each lateral area, in which the maximum value among each lateral area is applied. The third column represents the difference (shown in %) between the standard value and the average image covering density in each lateral area, calculated by the First Embodiment with respect to said printing data of each color. The fourth column shows the gradient area ratio (shown in %) of the toner patch images, to be formed in each lateral area of the inter-image areas of the photoconductors of each color, by the process of the First Embodiment.

In the above embodiment, the image forming apparatus uses a time period to print 5,000 sheets. Said time period represents a time period corresponding to the number of sheets to be printed in the present invention. If a time period is checked for each print, it is ideal for a precise calculation, however, which decreases the processing speed of the image forming apparatus, and is not an actual operation. Accordingly, continuous printing of 5,000 sheets is set as a normal operation-able level in the present invention.

Further, when the image forming apparatus conducts the continuous printing of 5,000 sheets, the image carrier travels 1.5 km, that is, the image carrier requires a time period to travel 1.5 km. Said time period represents a time period corresponding to a travel distance in the present invention.

Still further, when the image carrier, having a diameter of 60 mm, travels 1.5 km, said image carrier rotates approximately 8,000 turns, that is, said image carrier requires a time period to rotate 8,000 turns. Said time period represents a time period corresponding to a rotating number in the present invention.

The evaluation method of the First Embodiment: After said actual print tests, (being 5,000 continuously printed sheets) are conducted, original sheets of each color, carrying a monocolor half tone image (being the gradient area ratio of 50%) on the total surfaces, are printed, on which the uneven reflection density, exhibiting a longitudinal strip (which is the longitudinal streak), is checked visually.

The results of the tests of the First Embodiment: No uneven reflection density, dominantly generated with respect to yellow color and cyan color in the conventional image forming apparatus, is generated. Due to this result, the First Embodiment is effective to prevent said streaks. That is, in the present invention, when an original document, carrying the large difference of the average image covering density between each lateral area, is printed repeatedly, the adequate amount of toner particles (being abrasive particles) is always supplied to each lateral area by the edge of the cleaning blade. That is, it is presumed that each lateral area of the photoconductor is always polished by said edge.

Second Embodiment

The Second Embodiment will now be detailed, wherein the adjusting section of toner patch image forming section 109 differs from that of First Embodiment.

Procedure 1: The best possible maximum value, being 100%, which can be obtained at each lateral area, is referred to as the standard value.

Procedure 2: The standard value, obtained in Procedure 1, being 100%, is subtracted by the average image covering density in each lateral area, whereby any difference, between the standard value and the average image covering density of each area, is obtained.

Procedure 3: Based on the above difference obtained in Procedure 2, and on the conversion table, previously stored in memory section 107 of image forming apparatus 100, the densities of the patches in each lateral area, which are depending on the difference in each lateral area, are sequentially obtained.

TABLE 2

| Lateral | Average image covering density (%) | | | | Difference between standard value and average image covering density in each lateral area (%) | | | | Gradation area ratio of toner patch (%) | | | |
|---|---|---|---|---|---|---|---|---|---|---|---|---|
| areas | Y | M | C | K | Y | M | C | K | Y | M | C | K |
| Area 1 | 20 | 0 | 20 | 0 | 80 | 100 | 80 | 100 | 80 | 100 | 80 | 100 |
| Area 2 | 50 | 15 | 50 | 8 | 50 | 85 | 50 | 92 | 50 | 85 | 50 | 92 |
| Area 3 | 55 | 20 | 55 | 8 | 40 | 80 | 40 | 92 | 40 | 80 | 40 | 92 |
| Area 4 | 70 | 10 | 70 | 10 | 30 | 90 | 30 | 90 | 30 | 90 | 30 | 90 |
| Area 5 | 70 | 15 | 70 | 10 | 30 | 85 | 30 | 90 | 30 | 85 | 30 | 90 |
| Area 6 | 85 | 10 | 85 | 10 | 15 | 90 | 15 | 90 | 15 | 90 | 15 | 90 |
| Area 7 | 100 | 10 | 100 | 8 | 0 | 90 | 0 | 92 | 0 | 90 | 0 | 92 |
| Area 8 | 70 | 0 | 70 | 0 | 30 | 100 | 30 | 100 | 30 | 100 | 30 | 100 |

Table 2 shows the toner patch pattern formation of the Second Embodiment, wherein the structures of the first to fourth columns are the same as those of the First Embodiment.

The evaluation method of the Second Embodiment: being the same as in the case of the First Embodiment.

The results of the tests of the Second Embodiment: No uneven reflection density, exhibiting the longitudinal streaks, is generated, being the same as in the case of the First Embodiment, that is, the Second Embodiment is also effective to prevent the problem of said uneven density.

However, when compared to the First Embodiment, disadvantages were found, in which consumption of the magenta toner particles and the black toner particles increases. That is, in the First Embodiment, since the original document, carrying a large density difference between each lateral area, with respect to the average image covering density, is printed repeatedly, an adequate amount of toner particles (being abrasive particles) is always supplied to each lateral area by the edge of the cleaning blade, so that each lateral area of the photoconductor is always polished by said edge. However, since more toner particles are supplied than in the case of the First Embodiment, it is presumed that the photoconductor becomes more polished.

The Third Embodiment

The Third Embodiment will now be detailed, wherein the adjusting section of toner patch image forming section 109 differs from those of First and Second Embodiments.

Procedure 1: The average image covering density of each area is added to obtain a weighted average, and said weighted average is applied as the standard value.

Procedure 2: The weighted average, obtained in Procedure 1, is subtracted from the average image covering density in each lateral area, so that the difference, between the standard value and the average image covering density of each area, is obtained.

Procedure 3: Based on the above difference obtained in Procedure 2, and on the conversion table, previously stored in memory section 107 of image forming apparatus 100, the densities of the toner patches in each lateral area, which are depending on the difference in each lateral area, are sequentially obtained.

TABLE 3

| Lateral | Average image covering density (%) | | | | Difference between standard value and average image covering density in each lateral area (%) | | | | Gradation area ratio of toner patch (%) | | | |
|---|---|---|---|---|---|---|---|---|---|---|---|---|
| areas | Y | M | C | K | Y | M | C | K | Y | M | C | K |
| Area 1 | 20 | 0 | 20 | 0 | 45 | 10 | 45 | 6.75 | 45 | 10 | 45 | 6.75 |
| Area 2 | 50 | 15 | 50 | 8 | 15 | −5 | 15 | −1.25 | 15 | 0 | 15 | 0 |
| Area 3 | 55 | 20 | 55 | 8 | 10 | −10 | 10 | −1.25 | 10 | 0 | 10 | 0 |
| Area 4 | 70 | 10 | 70 | 10 | −5 | 0 | −5 | −3.25 | 0 | 0 | 0 | 0 |
| Area 5 | 70 | 15 | 70 | 10 | −5 | −5 | −5 | −3.25 | 0 | 0 | 0 | 0 |
| Area 6 | 85 | 10 | 85 | 10 | −20 | 0 | −20 | −3.25 | 0 | 0 | 0 | 0 |
| Area 7 | 100 | 10 | 100 | 8 | −35 | 0 | −35 | −1.25 | 0 | 0 | 0 | 0 |
| Area 8 | 70 | 0 | 70 | 0 | −5 | 10 | −5 | 6.75 | 0 | 10 | 0 | 6.75 |
| | 65 | 10 | 65 | 6.75 | ←standard value (being weighted average value) | | | | | | | |

Table 3 shows the toner patch pattern formation of the Third Embodiment, wherein the structures of the first to fourth columns are the same as those of the First and Second Embodiments.

The evaluation method of the Third Embodiment: being the same as in the cases of the First and Second embodiments.

The results of the tests of the Third Embodiment: The uneven reflection density, dominantly generated by the conventional image forming apparatuses, with respect to the yellow color and the cyan color, is greatly reduced to be only very slightly visible. Further, any uneven reflection density, slightly generated by the conventional image forming apparatuses, with respect to the magenta color and the cyan color, is completely cleared.

Due to the above result, it is understood that the Third Embodiment effectively clears the uneven density exhibiting the longitudinal streaks. Further, the consumption of toner particles is greatly reduced than in the case of the First and the Second Embodiments. Since the original document, carrying the large density difference between each lateral area, with respect to the average image covering density, is printed repeatedly, the adequate amount of toner particles (being abrasive particles) is always supplied to the lateral areas, having the average image covering density to be less than the weighted average, due to the function of the edge of the cleaning blade, based on the difference of the average image covering density, so that the toner particles (being the abrasive particles), being greater than the appropriate value, are always supplied to the total lateral areas of the photoconductor by the edge of the cleaning blade edge. That is, it is presumed that the total lateral areas of the photoconductor is always adequately polished.

In the above embodiments, the density of the toner patch image is changed in each lateral area, so that the percentage of the toner particles to be supplied to each lateral area is determined, however, it is possible that this method changes the dimensions of the toner patch image (which is the length of the toner patch image, measured in the rotational direction of the photoconductor).

Further, in the above embodiments, the toner patch image is formed in the inter-image areas, which is positioned between the image areas, however, it is also possible for the method to form the toner patch image on the inter-image area, when a plurality of printing images have been processed. In this regard, when the frequency to form the toner patch images decreases, it is necessary to increase the dimensions of the toner patch image (which is the length of the toner patch image, measured in the rotational direction of the photoconductor), in proportion with the number of the printing images. Still further, the same action is also necessary, based on the length of the printing image (which is the length of the printing image, measured in the rotational direction of the photoconductor).

By the above method, in which when a plurality of printing images have been processed, the toner patch image is formed on the inter-image area, the frequency to form the toner patch images decreases, which results in higher processing speed of the printer section. However, the burden of image covering density calculating section 106 increases. Actually, the embodiment is selected, based on the performance of image forming apparatus 100, or the characteristics of the individual sections.

Concerning the above embodiments, the relationship between (A) the difference between the standard value and the average image covering density in each lateral area, and (B) the gradation area ratio of the toner patch image, is shown by the solid line in FIG. 5. In more detail, said relationship is further based on the image transfer condition, the image developer prescription, the touching angle and touching points of the cleaning blade, or the like. Accordingly, the correction is conducted as shown by the dashed line in FIG. 5, whereby an appropriate transfer table can be formed by the experimental graph as shown in FIG. 5.

In the above embodiments, based on the differences between the standard value and the average image covering density in each lateral area, the amount of abrasive particles can be adjusted, which are to be supplied to each lateral area of the photoconductor. As another method, based on the differences between the average image covering densities of the lateral areas, the amount of abrasive particles, which is to be supplied to each lateral area of the photoconductor, can also be adjusted.

By the present invention, a large number of the original documents are printed, which carry the image covering density distributed perpendicular to the moving direction of the photoconductor, an adequate amount of toner particles (which are the abrasive particles) can be supplied to the total lateral areas of the photoconductor, by the edge of the cleaning blade, by which the homogeneous edge abrasion and the reduced speed of the edge abrasion are appropriately conducted, resulting in stabilized cleaning performance and longer usable life of the cleaning blade.

Additionally, when the amount of the toner particles, which are supplied to the photoconductor through the cleaning blade, becomes less, the edge of the cleaning blade is more rapidly abraded away.

What is claimed:

1. An image forming apparatus, comprising:

an image carrier;

an image forming section to form a toner image on the image carrier;

a transfer section to transfer the toner image formed on the image carrier to an intermediate transfer body or a recording sheet;

a cleaning section to remove not transferred toner particles remaining on the image carrier, an image covering density calculating section to calculate an average image covering density of the toner image formed on plural areas divided in a lateral direction of the image carrier, during a predetermined time period;

an obtaining section to obtain a difference of the average image covering density between each divided area, based on the image covering density calculated by the image covering density calculating section; and an adjusting section to adjust an amount of abrasive particles to be supplied to each divided area, based on the differences obtained by the obtaining section.

2. The image forming apparatus of claim 1, wherein the obtaining section obtains a difference between a standard value and the average image covering density in each divided area, calculated by the image covering density calculating section.

3. The image forming apparatus of claim 2, wherein the standard value comprises a maximum value among the average image covering densities in each divided area.

4. The image forming apparatus of claim 2, wherein the standard value comprises a best possible maximum value among the average image covering densities in each divided area.

5. The image forming apparatus of claim 2, wherein the standard value comprises a weighted average of the average image covering densities in each divided area.

6. The image forming apparatus of claim 1, wherein the abrasive particles comprise toner particles, and the image forming section doubles as the adjusting section.

7. The image forming apparatus of claim 1, wherein the predetermined time period corresponds to a time period in which the image carrier rotates to a predetermined number of rotations.

8. The image forming apparatus of claim 1, wherein the predetermined time period corresponds to a time period in which the image is formed on a predetermined number of the recording sheets.

9. The image forming apparatus of claim 1, wherein the predetermined time period corresponds to a time period in which the image carrier travels a predetermined distance.

10. The image forming apparatus of claim 1, wherein the adjusting section adjusts the amount of the abrasive particles to be supplied to a non-image forming area which exists between the image forming areas in the rotating direction of the image carrier.

11. The image forming apparatus of claim 1, wherein the adjusting section forms a toner patch image in each divided area, to determine the amount of the abrasive particles to be supplied to the image carrier.

12. The image forming apparatus of claim 11, wherein the amount of the abrasive particles is determined by an area of the toner patch or a density of the toner patch image.

13. The image forming apparatus of claim 1, wherein the cleaning section comprises a blade cleaning section in which an edge of a blade comes into contact with the image carrier.

* * * * *